US008602822B2

(12) United States Patent
Siahaan et al.

(10) Patent No.: US 8,602,822 B2
(45) **Date of Patent: *Dec. 10, 2013**

(54) CONNECTOR DEVICES HAVING INCREASED WELD STRENGTH AND METHODS OF MANUFACTURE

(75) Inventors: Edward Siahaan, San Francisco, CA (US); John B. Ardisana, II, San Francisco, CA (US); Albert J. Golko, Saratoga, CA (US); Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 244 days.

This patent is subject to a terminal disclaimer.

(21) Appl. No.: 13/252,460

(22) Filed: Oct. 4, 2011

(65) Prior Publication Data

US 2013/0084746 A1 Apr. 4, 2013

(51) Int. Cl.
*H01R 9/03* (2006.01)

(52) U.S. Cl.
USPC ..... 439/607.41; 439/607.55; 439/660; 29/857

(58) Field of Classification Search
USPC ..... 439/607.41, 607.5, 607.55, 660, 905
See application file for complete search history.

(56) References Cited

U.S. PATENT DOCUMENTS

| | | | | |
|---|---|---|---|---|
| 4,691,973 | A | 9/1987 | Rosheim | |
| 4,916,804 | A * | 4/1990 | Yoshimura et al. | 29/592.1 |
| 7,118,414 | B2 | 10/2006 | Spears et al. | |
| 7,144,274 | B2 | 12/2006 | Taylor | |
| 7,273,397 | B2 | 9/2007 | Watanabe et al. | |
| 7,359,208 | B2 | 4/2008 | Ni | |
| 7,503,780 | B1 | 3/2009 | Huang | |
| 7,695,318 | B1 | 4/2010 | Wamg et al. | |
| 7,887,370 | B2 * | 2/2011 | Chen et al. | 439/607.35 |
| 7,965,318 | B2 * | 6/2011 | Huang | 348/208.7 |
| 8,333,616 | B2 * | 12/2012 | Su et al. | 439/660 |
| 2006/0160415 | A1 | 7/2006 | Pollock | |
| 2011/0123159 | A1 | 5/2011 | Little et al. | |
| 2012/0071022 | A1 * | 3/2012 | Su et al. | 439/449 |

FOREIGN PATENT DOCUMENTS

| | | |
|---|---|---|
| CN | 201829739 U | 5/2011 |
| CN | 201829742 U | 5/2011 |

OTHER PUBLICATIONS

Invitation to Pay Additional Fees mailed on Dec. 3, 2012 for PCT Patent Application No. PCT/US2012/056938, 6 pages.

International Search Report and Written Opinion of the International Searching Authority mailed on Feb. 7, 2013 for PCT Patent Application No. PCT/US2012/056938, 23 pages.

* cited by examiner

*Primary Examiner* — Xuong Chung Trans
(74) *Attorney, Agent, or Firm* — Kilpatrick Townsend & Stockton LLP

(57) ABSTRACT

Devices and methods of manufacture for improved connector plugs are provided herein. In one aspect, an exemplary connector plug comprises a shield shell having a proximal stepped-down portion and a boot member that fittingly receives the stepped-down proximal portion so that an outer surface of the distal shield shell and the boot member is about flush with a minimal or negligible space therebetween. In some embodiments, the shield shell comprises a separate front shield shell and a reduced profile rear shield shell welded together so as to provide the advantageous reduced profile and improved aesthetic appearance, while maintaining the structural integrity of the connector. In many embodiments, weld strength of the shield shells is improved by providing line-to-line contact between shield shells by using deflectable tabs and/or utilizing thermal expansion properties of one or both shield shells.

24 Claims, 11 Drawing Sheets

Section A - A

CONNECTOR DEVICES HAVING INCREASED WELD STRENGTH AND METHODS OF MANUFACTURE

BACKGROUND

Data transfers between devices such as computers and peripheral devices, including portable media devices, have become ubiquitous over the last several years. Music, phone numbers, video, and other data are moved among these devices, often using universal serial bus (USB), FireWire™, DisplayPort™, or other types of cables. Such cables are used to form electrical pathways for signals that carry this information between devices.

These electrical connections are typically formed by inserting a connector plug on each end of a data cable and inserting into connector receptacles located on each of the computer and peripheral device. A typical connector plug includes a distal plug portion having one or more contact terminals and a proximal base portion, such as a boot member, by which a user grasps the connector plug to insert or withdraw the distal plug portion into a compatible receptacle.

In many industries, connectors must comply with certain design standards, such as the Universal Serial Bus (USB) Standard, which require that the construction of a given connector adheres to particular specifications, which may include dimensions, materials and/or material thicknesses. Often, connectors, such as USB connectors for example, include a shield shell to reduce interference near the contact terminals and a boot member that protects the connection between the cable and the contact terminals as well as provides the user with a grasping surface for inserting and removing the distal plug portion. Given the above constraints in connector design, conventional connectors typically include a boot member having a substantially larger profile than that of the shield shell, and often include a transitional zone or gap between the shield shell and the boot member. Such conventional connectors may appear bulky and the increased profile of the boot member may prevent the use of multiple connectors in close proximity. In many connector plugs, the applicable design standards limit the ability customize and alter the plug as desired, and attempts to modify connector plugs within the design standard may compromise the strength and durability of the connector.

SUMMARY

Accordingly, embodiments of the present invention provide structures and methods of manufacture for improved connector plugs that avoid the above noted drawbacks of many conventional connectors. In one aspect, the invention allows for improved connector plugs having a reduced profile and improved aesthetic appearance, while maintaining the structural integrity of the connector. In many embodiments, the device and methods provide a connector plug having a reduced profile along a length of the connector. Some embodiments provide a connector plug having a shield shell and boot member having outer surfaces that are substantially flush, with minimal or negligible space in between the shell and boot member.

In one aspect, the present invention includes a shield having a distal portion and a stepped-down proximal portion, wherein the stepped-down proximal portion has a reduced profile relative to the distal portion, a boot member having a distal cavity dimensioned to fittingly receive the stepped-down proximal portion such that an outer surface of the boot member is about flush with an outer surface the distal portion of the shield shell along a length of the connector, and a plurality of terminals disposed within the shield shell and electrically coupled to a cable extending through the shield shell and boot member. In some embodiments, the shield shell comprises a front shield shell corresponding to the distal portion, and a rear shield shell corresponding to the stepped-down proximal portion, wherein the front shield shell and the rear shield shell are fixedly attached, usually welded together. In certain embodiments, line-to-line contact between front and rear shield shells is provided to facilitate welding between shield shells. This line-to-line contact may be provided by using a rear shield shell having radially extending deflectable tabs that engage an inside surface of the front shield shell when placed within. In another embodiment, the invention utilizes thermal expansion properties of the front shield shell by heating the front shield shell to allow positioning of the rear shield shell within, then cooling the front shield shell to contract against the rear shield shell so as to provide sufficient line-to-line contact to weld the shells together, typically in a substantially continuous weld between a raised ridge of the rear shield shell and an inside surface of the front shield shell.

In another aspect, methods are provided for the manufacture of a connector plug in accordance with many embodiments of the invention. In one embodiment, the method includes providing a shield shell having a stepped-down proximal portion, inserting a plurality of terminals within the shield shell, electrically coupling the plurality of terminals with a cable, and advancing a boot member so as to receive the stepped-down proximal portion so that an outer surface of the boot member is about flush with an outer surface of a distal portion of the shield shell, there being a minimal or negligible space therebetween. In another embodiment, the method includes positioning a rear shield shell within a front shield shell so that the rear shield shell extends proximally of the front shield shell to form the stepped-down portion and fixedly attaching the front and shield shell together, such as by welding. In one aspect, welding the front and shield shell together may include providing line-to-line contact between shield shells, which may include engaging an inside surface of the front shield shell with one or more deflectable tabs of the rear shield shell, or cooling a front shield shell from an elevated temperature such that contraction of the front shield shell engages an outer raised ridge of the rear shield shell with the inside surface of the front shield shell.

Various embodiments of the present invention may have a thickness or height that is compliant with a USB standard, although the invention may include some embodiments that may not necessarily comply with the standard but have dimensions so as to be compatible with a particular receptacle.

In various embodiments of the present invention, the connector plug may be a USB, DisplayPort, IEEE 1394 (FireWire), Ethernet, or other type of connector receptacle. The connector receptacle housings can be formed from the same material used to form the enclosure for the device that includes the connector receptacle. These materials can include aluminum, plastic, ceramics, or other material. The shield, terminal, boot member, and other components can be formed using any suitable conductive or nonconductive materials, such as aluminum, brass, steel, stainless steel, spring steel, palladium nickel alloy, copper, and other materials. These materials may be plated, for example, they may be palladium-nickel plated, or plated with other appropriate materials. Connector plugs consistent with embodiments of the present invention may be attached to a cable or to a computer, or other such device, such as those used with desktop computers, laptop computers, netbook computers, media players, portable media players, tablet computers, cell phone, or other electronic devices.

Various embodiments of the present invention may incorporate one or more of these and the other features described herein. A better understanding of the nature and advantages of the present invention may be gained by reference to the following detailed description and the accompanying drawings.

DETAILED DESCRIPTION

Embodiments of the present invention generally relate to connectors, and in particular connector plugs. More specifically, the present invention relates to connector plugs having a reduced profile and an improved aesthetic appearance, for example, a USB connector plug having a shield shell and a boot member with outer surfaces that are about flush with substantially no space therebetween. In another aspect of the invention, methods for manufacturing such connector devices are provided.

Accordingly, the present invention provides connector plugs having a reduced profile along a length of the connector while maintaining the structural integrity of the connector, and further provides for an improved aesthetic appearance. Some examples of the claimed apparatus and methods are shown in the following figures. These figures, as with the other figures herein, are shown for illustrative purposes and do not limit either the possible embodiments of the present invention or the claims.

Figure 1:
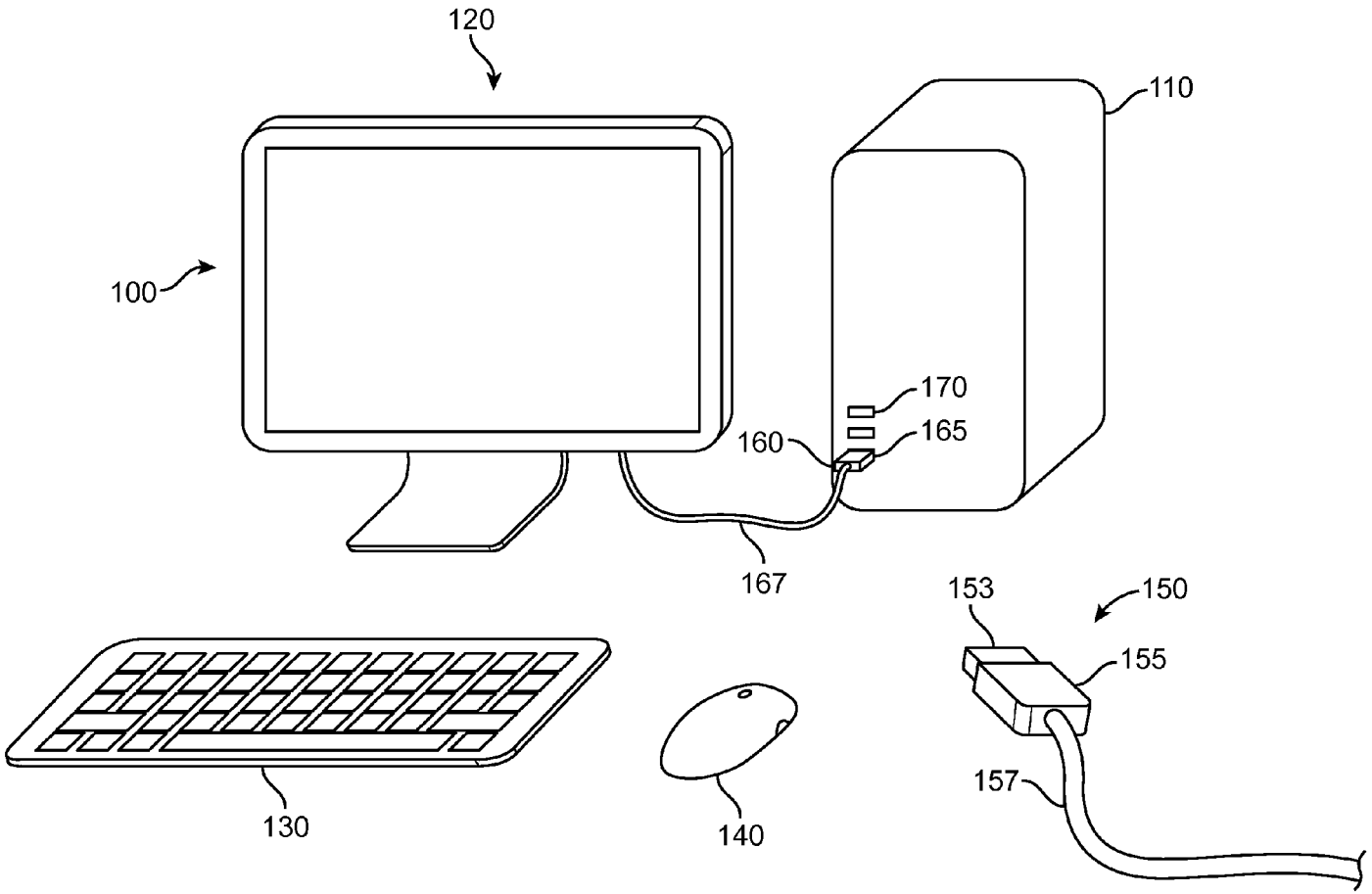
FIG. 1 illustrates a computer system that may be improved by the incorporation of embodiments of the present invention.

FIG. 1 illustrates a conventional computer system that is improved by the incorporation of embodiments of the present invention. This figure shows an example of a computer system 100 that includes computer enclosure 110, computer monitor 120, keyboard 130, and mouse 140.

Monitor 120, keyboard 130, and mouse 140 may connect to computer enclosure 110 via cables. For example, computer monitor 120 is shown as being connected to computer enclosure 110 via cable 167. Cable 167 connects to computer enclosure 110 with a connector plug 160 inserted into the connector receptacle 165. Connector plug 150, similar to plug 160, includes a distal plug portion 153 insertable into receptacle 170, and a boot member 155 by which the user grasps the plug to insert the distal plug portion 153 into a corresponding receptacle. As shown in FIG. 1, the boot member 155 has a substantially larger profile than the insertable plug portion 153 in connector 150, a common design feature in conventional connector plugs. The increased profile of the boot member 155 requires receptacle 170 be sufficiently spaced apart from adjacent receptacles to accommodate the increased dimensions of the boot member of an adjacent connector plug when inserted into the adjacent receptacle. Therefore, the above described conventional connector design would require increased space within the computer enclosure since the receptacles would need to be spaced sufficiently apart to maintain their utility.

Embodiments of the present invention may be employed to overcome the above noted disadvantages of conventional connector design and to improve the aesthetic appearance of such connectors. These connector plugs may be compatible with USB, FireWire, DisplayPort, Ethernet, and other types of signaling and power transmission standards. These connector plugs may be compatible with proprietary signaling and power transmission technologies. Also, as new signaling and power transmission standards and proprietary technologies are developed, embodiments of the present invention may be used to improve connector plugs consistent with those standards and technologies. The connector plugs may be located on cables, such as data cables 167 and 157, for connecting two devices, such as monitor 120 and computer 110, or other such devices, including but not limited to desktop computers, laptop computers, netbook computers, media players, portable media players, tablet computers, cell phone, or other electronic devices.

In an exemplary embodiment, the connector plug includes a distal plug portion having contact terminals within and a proximal boot member that protects the connections of the contact terminals with the associated cable and provides a grasping surface for inserting and removing the connector plug. The distal plug portion typically includes a metal shield for reducing interference where the contact terminals of the plug interface with corresponding contact terminals in a receptacle so as to maintain signal integrity in the connection. The shielding on the distal plug portion makes electrical contact with metallic finger contacts on a connector receptacle housing to form an electrical connection, the connector receptacle housing being connected to ground inside the computer enclosure 110. The boot portion typically comprises an insulating polymer or a non-metal material and may help secure an associated cable to the distal plug portion and terminal therein.

An applicable connector design standard, such as the USB standard, imposes various requirements on the construction of a particular connector plug. In particular, in a USB connector plug for example, the standard specifies the length, width, height, type of cable, number of pins, as well as the shield thickness, to ensure the connector plug is insertable and compatible with a standard USB connector receptacle. In various embodiments of the present invention, the height or thickness of connector receptacle may be in compliance with the application specification, although in other embodiments one or more design aspects may not be in compliance with this specification. In these cases, the dimensions of the connector plug remain sufficient so as to be compatible with an associated receptacle.

Figure 2A:
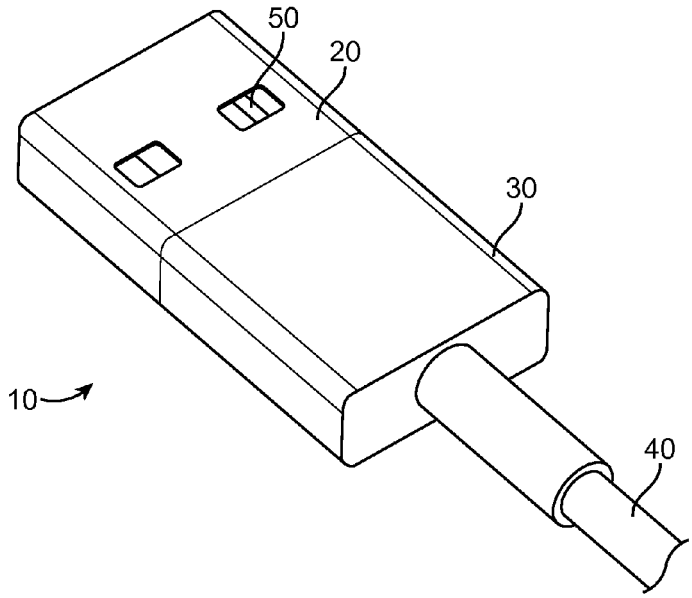
FIGS. 2A-2C illustrate an exemplary connector plug, shield shell and boot member, in accordance with many embodiments of the present invention.

FIG. 2A illustrates a connector plug 10 according to an embodiment of the present invention. Connector plug 10 is made to comply with the USB standard and comprises a shield shell 20 and a boot member 30 which fits over a proximal portion of shield shell 20. A group of terminals 50 are disposed within a distal portion of shield shell 20 and are connected to a group of wires of cable 40 extending through boot member 30. Boot member 30 fits over a proximal portion of shield shell 20 such that when fully assembled only the distal portion of shield shell 20 is visible, as shown in FIG. 2A. When fully assembled, the distal portion of shield shell 20 and boot member 30 each have a rectangular cross-section that is substantially constant along the length of the connector 10, and the exterior surface of boot member 30 is substantially flush with the exterior surface of the distal portion of shield shell 20, with little or no space between the two outer surfaces, so that the boot member 30 and shield shell 20 appear seamless. This flushed and zero gap design not only improves the aesthetic appearance of the connector plug, but it reduces the profile of the boot member in each direction, thereby allowing for use of multiple connector plugs in closer proximity than would be possible in the conventional design described above.

Figure 2B:
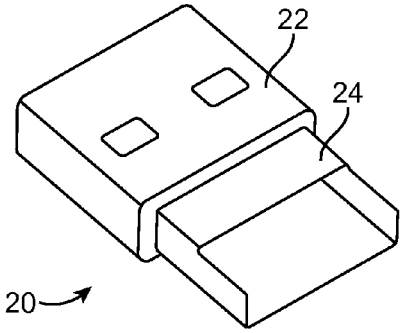
Figure 2C:
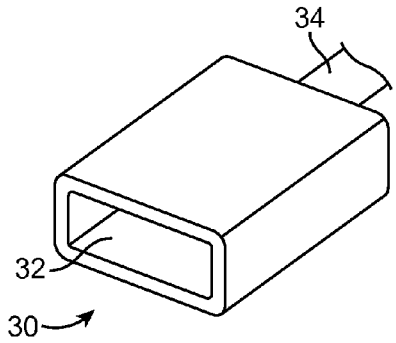

FIGS. 2B and 2C show detail views of the shield shell 20 and boot member 30 of connector plug 10. As can be seen in FIG. 2B, shield shell 20 includes a distal portion 22 insertable into a receptacle and a proximal stepped-down portion 24 having a reduced profile.

Boot member 30 includes an axial passageway extending therethrough so as to allow the wires of cable 40 to extend through the boot member 30 and attach to terminals 50 when assembled. Boot member also includes a distal cavity 32 and a cable interface 34 that slides along cable 40 during assembly. Distal cavity 32 is dimensioned so as to slidably receive the proximal stepped-down portion 24. The increase in the cross-sectional profile of the shield shell 20 between the proximal portion 24 and the distal portion 22 is approximately the thickness of the boot member around the distal cavity 32 such that when the proximal stepped-down portion is fittingly received within the distal cavity 22 of the boot member 30, the outer surface of boot member 30 is about flush with the outer surface of the distal plug portion 22, as shown in FIG. 2A. The stepped-down portion 24 may be formed in any manner of ways, including but not limited to: bending the outer walls of a shield shell to reduce the profile in a proximal portion; half-shearing the walls of a shield shell to reduce the profile in a proximal portion; and more typically, coupling a front shield shell 22 and a rear shield shell 24 together, wherein the rear shield shell 24 is manufactured with the reduced profile desired for the stepped-down proximal portion. Typically, the front and rear shield shell will be fixedly coupled, such as with an adhesive or a weld, so as to form shield shell 20.

One advantage of the welding separate components to form shield shell 20 is increased strength, since bending or half-shearing of an outer wall may compromise the material strength of the shield shell. By welding a front and rear shield shell together, each fabricated with the desired profile, each shield shell retains its original strength, while the weld joint may further increase the strength of shield shell 20. Various ways in which this means of attachment may be carried out are described in further detail in the descriptions of FIGS. 4A-4B and 5A-5C.

FIGS. 3A-3E illustrate the assembly of an exemplary connector plug 10 in accordance with many embodiments.

Figure 3A:
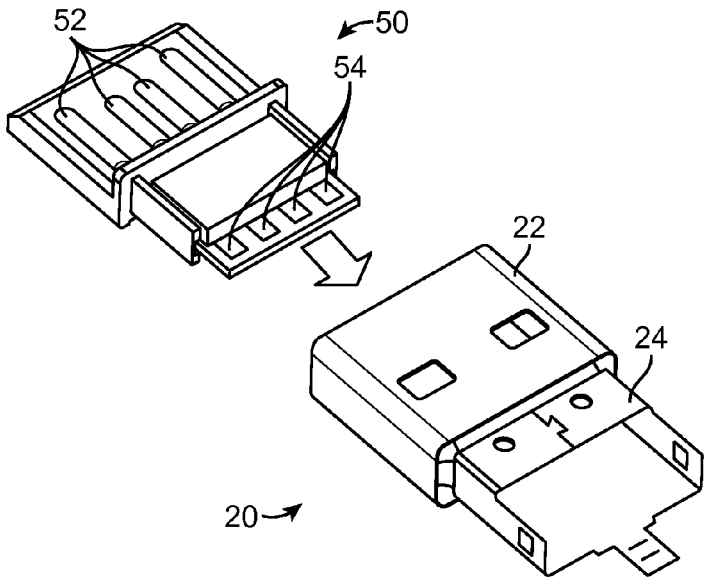
FIGS. 3A-3E illustrate the assembly of an exemplary connector plug, in accordance with methods of the present invention.

FIG. 3A shows a group of contact terminals on a terminal insert component 50 before the terminal insert 50 is positioned within shield shell 20. Terminal insert 50 is a prefabricated component which includes a group of contact terminals 52 positioned and spaced such that when the fully assembled connector plug 10 is inserted into a compatible receptacle, the contact terminals 52 engage corresponding contact terminals of the receptacle, thereby allowing communication between the two device connected by connector plug 10. The contact terminals 52 are electrically coupled with terminal pads 54 on a proximal portion of the terminal insert 50 for attachment to the wires of a cable in a subsequent step. Terminal insert 50 is configured so as to be slidably inserted through a distal opening of the front shield shell 22 and received, at least partially within the stepped-down proximal portion 24. After insertion, terminal insert 50 may be glued or soldered into place.

Figure 3B:
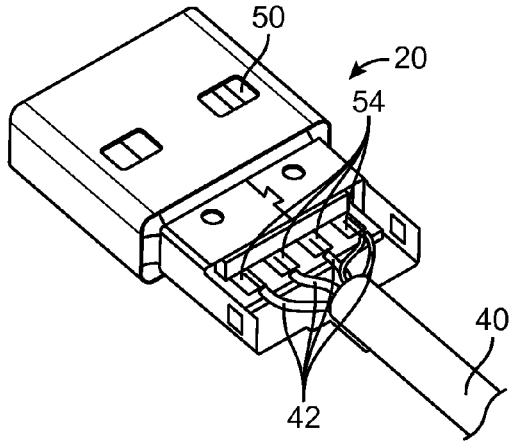

FIG. 3B shows the contact terminal pads 54 electrically coupled to cable 40. Cable 40 contains a group of wires 42, one for each of the contact terminal pads 54, each of which is soldered to the corresponding terminal pad 54 to facilitate communication between the cable 40 and the contact terminals 52.

Figure 3C:
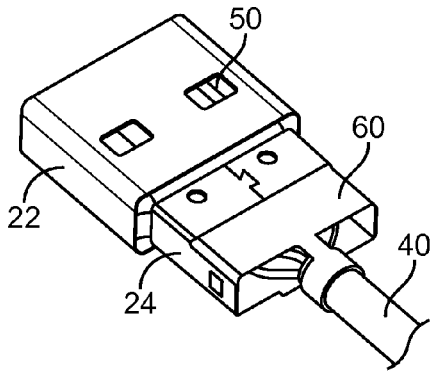

FIG. 3C shows the assembly of FIG. 3B after a protective plate 60 is snapped into place. The proximal stepped-down portion 24 of shield shell may include a coupling feature, for example two square holes on either side, that engage a corresponding coupling feature, such as two resilient tabs, in the protective plate 60. The protective plate 60 covers the solder joint between the wires of cable 40 and the conductive pads of the terminal insert 50 and may also include a proximal feature that secures the cable 40 to the shield shell so as to avoid placing stresses on the soldering joints when the cable 40 is tensioned during everyday use.

Figure 3D:
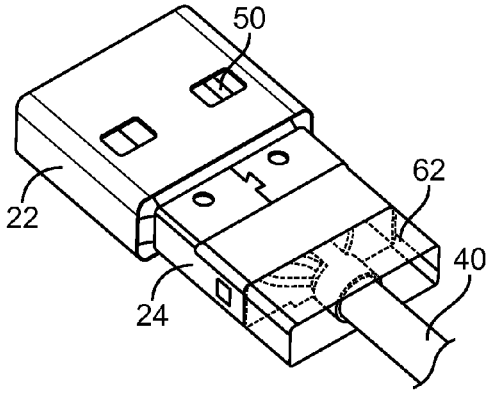

FIG. 3D shows the assembly after a mold 62 has been formed near where the cable 40 joins the shield shell 20, which further protects the soldering joints and secures cable 40.

Figure 3E:
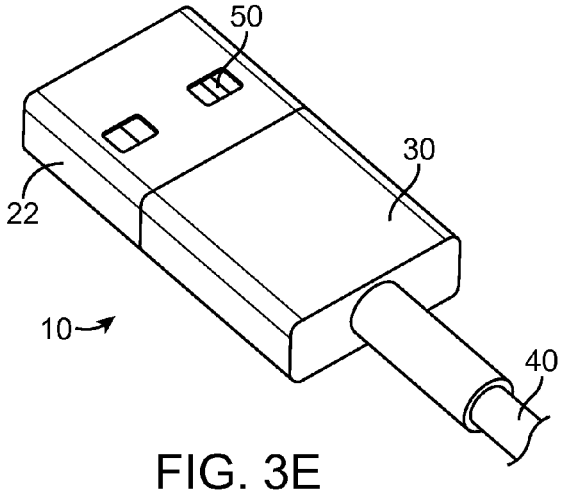

FIG. 3E shows the assembly after the boot member 30 has been advanced along cable 40 until the proximal stepped-down portion 24 of shield shell 20 has been received within its distal cavity 32 (not shown). When assembled, the boot member 30 is advanced until a distal edge of boot member 30 abuts against a proximal edge of the distal portion 24 so that there is effectively no gap (or a negligible gap) between the front shield shell 22 and boot member 30.

Figure 4A:
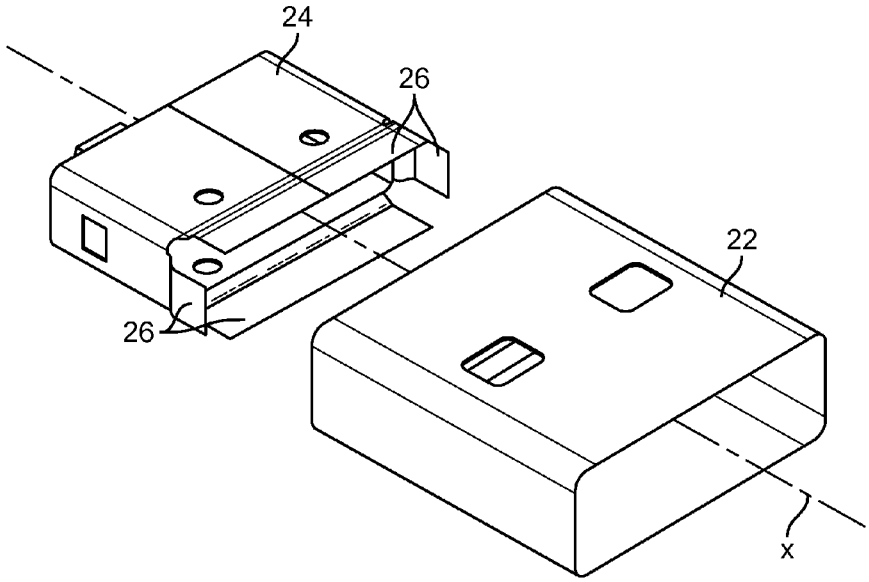
FIGS. 4A-4B illustrate the assembly of an exemplary connector plug, in accordance with methods of the present invention.
Figure 4B:
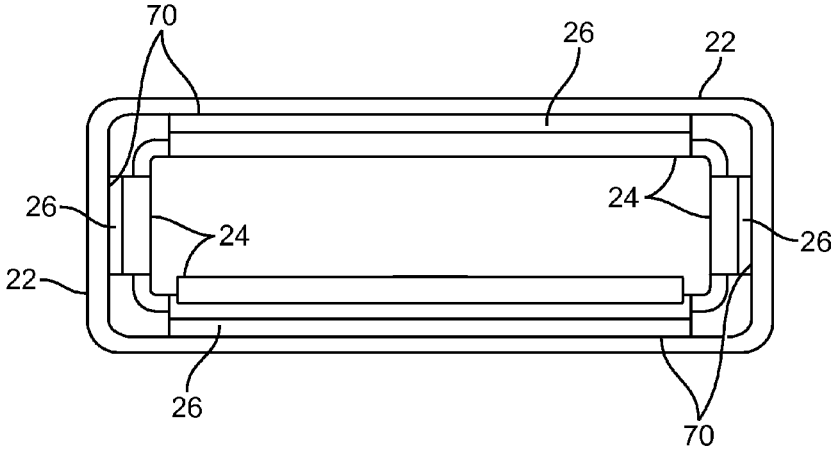

FIG. 4A shows a front shield shell 22 and rear shield shell 24 in accordance with many embodiments. When coupled together, the front shield shell 22 forms the distal plug portion for inserting into a receptacle and rear shield shell 24 forms the stepped-down proximal portion for sliding into the distal cavity of the boot member. In another method of forming shield shell 20, the rear shield shell 24 is positioned within the front shield shell 22 and fixedly attached to the inside surface. The rear shield shell 24 is positioned within the front shield shell 22 so that a proximal portion of the rear shield shell 24 extends proximally outside of the front shield shell 22 to form the proximal stepped-down portion. Once positioned as desired, the front and rear shield shells are fixedly coupled together by welding the rear shield shell to an inside surface of the front shield shell, as shown by laser welds 70 as shown in FIG. 4B. In other embodiments, the rear and front shield shell may be attached by any suitable means, including adhesives or mechanical coupling, such with a snap-fit mechanism. Welding of the components is advantageous as high-strength weld joints are sufficiently durable to outlast the useful life of most connector plugs. To ensure a proper weld joint, the rear shield shell and front shield shell should have line-to-line contact between the surfaces welded together. Such line-to-line contact may be provided in various ways, at least some of which are described herein.

Deflectable Tabs

In one aspect of the invention, the rear shield shell 24 includes deflectable tabs 26 that extend distally near the distal end of the rear shield shell, as shown in FIG. 4A. As the rear shield shell 24 is dimensioned so as to fit within the axial passageway (along the x-axis) of the front shield shell 22, the deflectable tabs extend radially outward so that when the rear shield shell 24 is received within the axial passageway of the front shield shell 22, the deflectable tabs 26 deflect inward and exert an outward force on the inner walls of front shield shell 22.

In an exemplary embodiment, the front shield shell 22 and rear shield shell 24 are each dimensioned as rectangular prisms, as in FIGS. 4A-4B. In a rectangular rear shield shell, there are at least four deflectable tabs, at least one on each side of the shield shell, so as to evenly distribute stresses along the weld on each side, although it is appreciated that other embodiments may use fewer or greater numbers of deflectable tabs. Likewise, one of skill in the art could modify the deflectable tabs so as to be suitable for shield shells of differing shapes and sizes. For example, a circular shield shell may include a front and rear shield shell, similar to the shield shells described herein, the rear shield having one or more deflectable tabs for attaching a circular rear shield (or other suitable shape) to a circular front shield shell. Alternatively, other embodiments may include various other shapes of the front and/or rear shield shells.

In one method of providing a connector plug in accordance with embodiments of the claims invention, the rear shield shell 24 having deflectable tabs 26 is positioned within the front shield shell 22 by inserting a proximal portion of the rear shield shell 24 into the distal opening of the front shield shell 22 until the deflectable tabs 26 engages an inside surface of the front shield shell 22 and the proximal most portion of the rear shield shell 24 extends proximally outside of the front shield shell 22. The force of the deflectable tabs 26 against an inside surface of the front shield shell 22 provides sufficient line-to-line contact between the surfaces to ensure a proper weld. In another method, once the rear shield shell 24 is positioned as desired, the front shield shell 22 and the rear shield shell 24 are fixedly attached by laser welding the deflected tabs 26 to the inside surface of the front shield shell 22. Typically, the laser welding is performed through distal opening of the front shield shell 22.

Thermal Expansion

In another aspect of the invention, line-to-line contact between a front shield shell 22 and rear shield shell 24 may be provided by utilizing thermal expansion properties of one or both of the shield shells. The front and rear shield shell may be fabricated from the same type of metals or materials, or from differing types of metals or materials. Typically, in such an embodiment, one or both of the front and rear shield shells, are fabricated from a stainless steel alloy. In such an embodiment, the front shield shell 20 would typically expand when heated to a higher temperature. By dimensioning the rear shield shell 24 to be easily received within the axial passageway of the front shield shell 22 when heated, line-to-line contact between the shield shells can be provided simply by cooling the front shield shell 22 after positioning the rear shield shell 24 within.

Figure 5A:
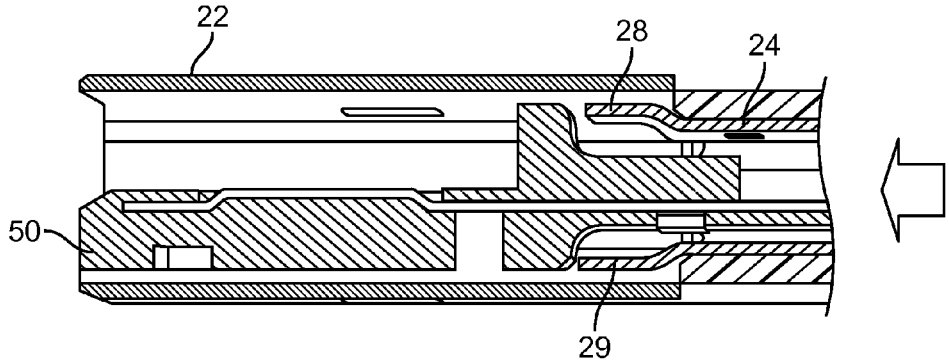
FIGS. 5A-5C illustrate the assembly of an exemplary connector plug utilizing thermal expansion properties of the front shield, in accordance with methods of the present invention.
Figure 5B:
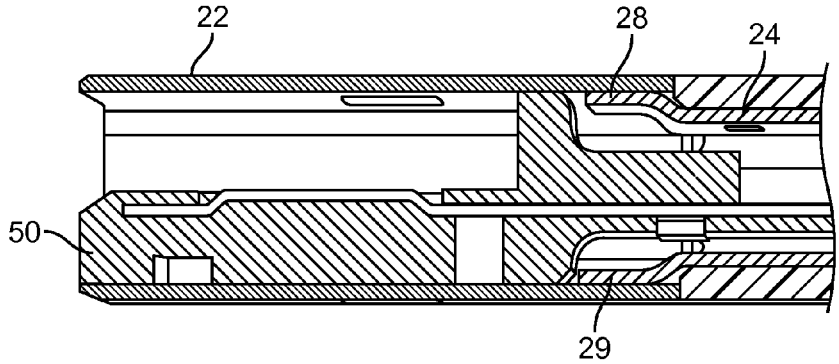
Figure 5C:
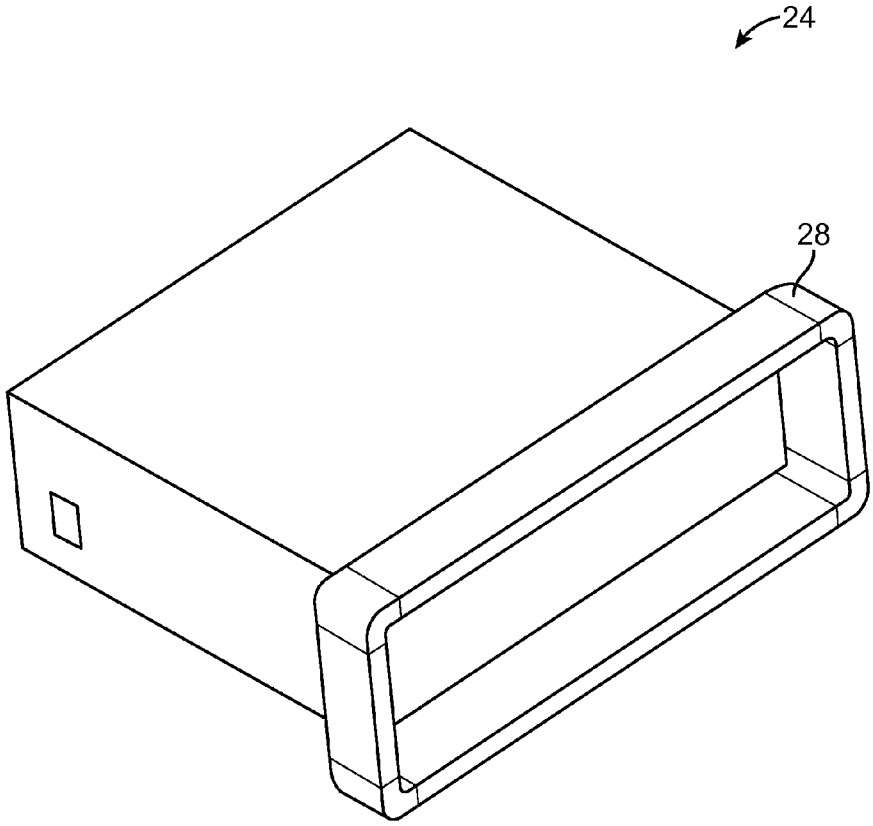

FIGS. 5A and 5B illustrate this thermal expansion aspect of the above described embodiment. In FIG. 5A, the front shield shell 22 is heated to a high temperature ($t_2$), typically greater than 200 deg C., while rear shield shell 24, remaining at a substantially lower temperature ($t_1$) fits easily within the axial passageway of the front shield shell 22 since the axial passageway of the front shield shell 22 has expanded due thermal expansion of the material comprising the front shield shell 22. Once the rear shield shell 24 is positioned so that a proximal portion extends outside of the front shield shell 22, cooling the front shield shell to a lower temperature, such as $t_2$, contracts the axial passageway securing the rear shield shell 24 in place while providing sufficient line-to-line contact for welding. One advantage of this embodiment, is that the rear shield shell 24 and front shield shell 22 may form a more secure line-to-line contact that may result in a stronger, more precise weld. Additionally, since this embodiment does not rely on the deflection of a tab on the rear shield shell 24, this embodiment may utilize a continuous raised portion at the distal end of rear shield shell that forms line-to-line contact, allowing for a substantially continuous weld about the inside of the axial passageway. Such a continuous weld would provide significantly improved weld strength as well as a more even distribution of stresses through the substantially continuous weld joint. An example of a rear shield shell 24 having such a continuous raised ridge 28 is illustrated in FIG. 5C.

Figure 6A:
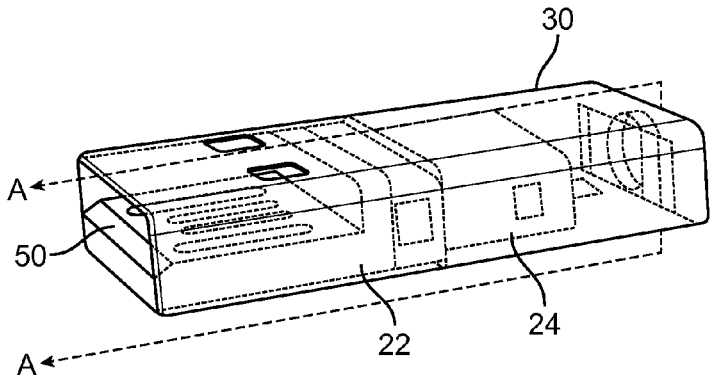
FIGS. 6A-6B illustrate an assembly of a front shield shell, a rear shield shell, a terminal insert, and a boot member, in accordance with many embodiments of the present invention.
Figure 6B:
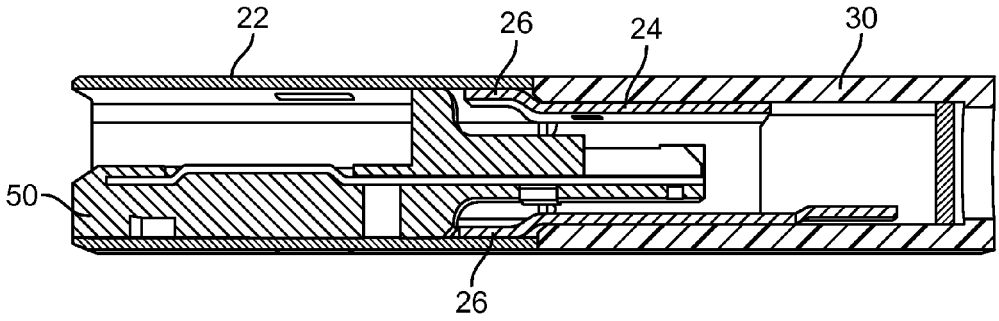

FIGS. 6A and 6B show a partially assembled connector plug and an associated cross-sectional view, respectively. FIG. 6A illustrates a shield shell 20 formed from a front shield shell 22 coupled to a rear shield shell 24. A boot member 30 has been advanced over the proximal most portion of the rear shield shell 24 until the boot member 30 abuts against the front shield shell 22. A terminal insert 50 has been inserted into the front shield shell and fixedly attached. The front shield shell 20 may include holes, divots or depressed areas to facilitate a friction fit or a snap fit to hold terminal insert 50 into place, or alternatively, terminal insert 50 may be attached by a weld or an adhesive. FIG. 6B shows a cross-sectional view of section A-A, which extends lengthwise along the assembly in FIG. 6A.

In another aspect, the invention provides a method for manufacturing a connector plug which may include: providing a shield shell having a proximal stepped-down portion; inserting a terminal insert within a distal portion of the shield shell; electrically coupling a cable to the terminal insert; and advancing a boot member over the stepped-down portion so that an outer surface of the boot member is about flush with an outer surface of the distal portion of the shield shell, there being little or no gap in between. In one embodiment, providing a shield shell having a proximal stepped-down portion comprises bending the sidewalls of a proximal portion of a shield shell so as to form a stepped-down proximal portion having a reduced profile as compared to the distal portion. In another embodiment, providing a shield shell having a proximal stepped-down portion comprises half-shearing the sidewalls of a shield shell so as to form a stepped-down proximal portion having a reduced profile as compared to the distal portion.

Figure 7:
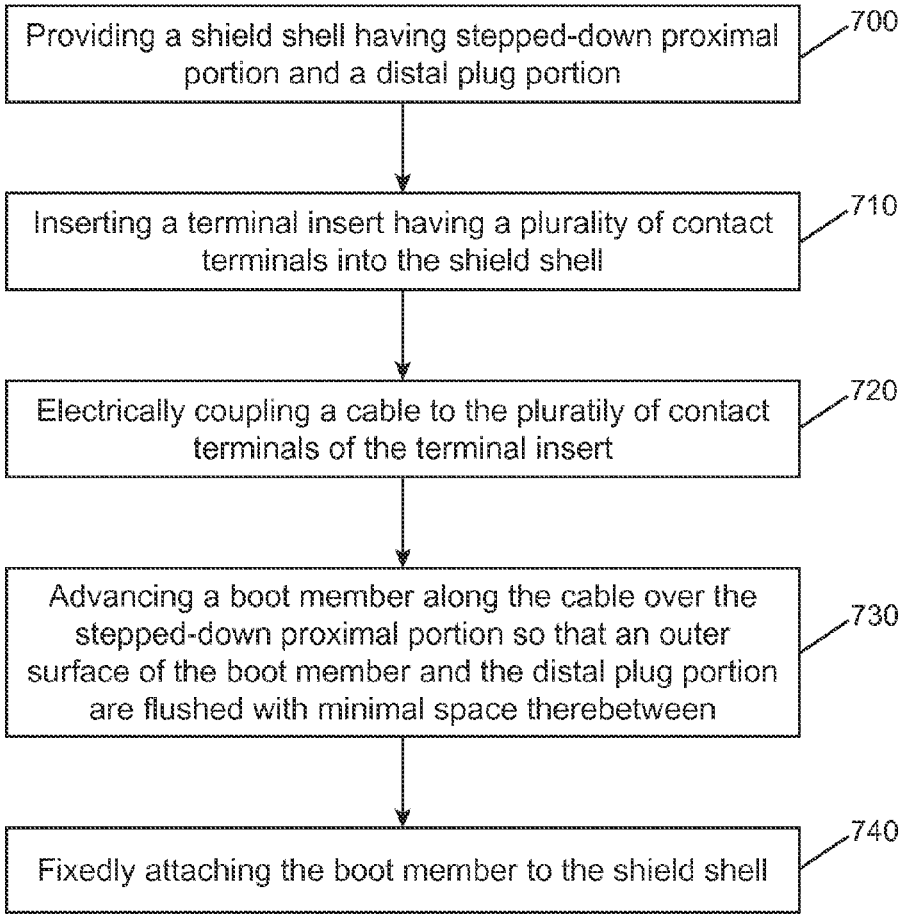
FIG. 7-9 illustrate exemplary methods of manufacturing a connector plug, in accordance with many embodiments of the present invention.
Figure 8:
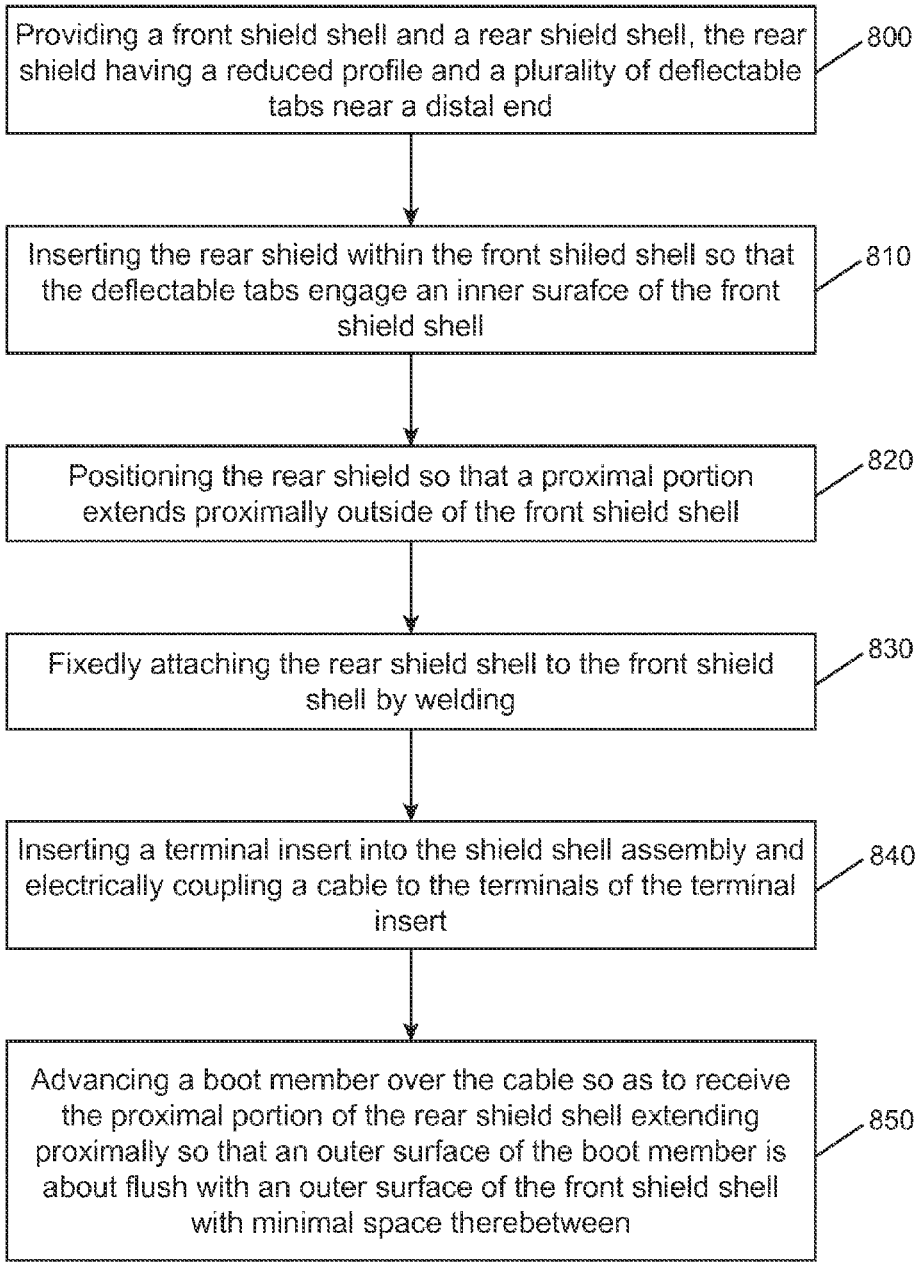
Figure 9:
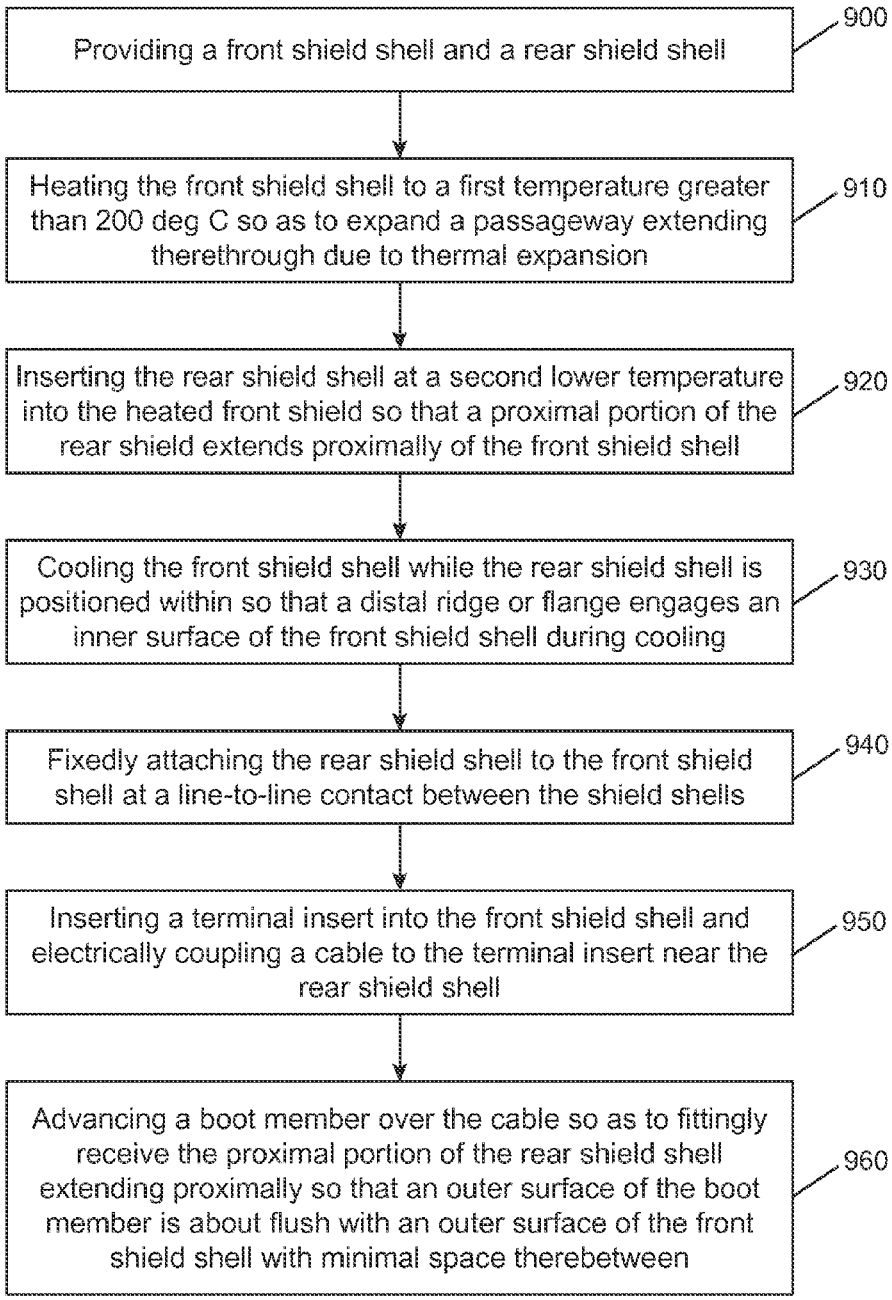

FIGS. 7-9 illustrate exemplary methods of manufacturing connector devices, in accordance with many embodiments of the claimed invention.

The method depicted in FIG. 7 includes: providing a shield shell having a stepped-down proximal portion and a distal plug portion 700; inserting a terminal insert into the shield shel 710; electrically coupling a cable to the terminal insert 720; advancing a boot member along the cable over the stepped-down proximal portion so that an outer surface of the boot member and the distal plug portion are flushed with a minimal space therebetween 730; and fixedly attaching the boot member to the shield shell, typically by welding the components together 740.

The method depicted in FIG. 8 includes: providing a front shield shell and a rear shield shell, the rear shield having a reduced profile and a plurality of deflectable tabs near a distal end 800; inserting the rear shield within the front shield shell so that the deflectable tabs engage an inner surface of the front shield shell 810; positioning the rear shield so that a proximal portion extends proximally outside of the front shield shell 820; fixedly attaching the rear shield shell to the front shield shell by laser weld 830; inserting a terminal insert into the shield shell assembly and electrically coupling a cable to the terminals of the terminal insert 840; and advancing a boot member over the cable to receive the proximal portion of the rear shield shell extending proximally so that an outer surface of the boot member is about flush with an outer surface of the front shield shell with little or minimal space therebetween 850.

The method depicted in FIG. 9 includes: providing front shield shell and a rear shield shell 900; heating the front shield shell to a first temperature greater than 200 degrees Celcius so as to expand a passageway extending therethrough due to thermal expansion 910; inserting the rear shield shell at a lower second temperature into the heated front shield so that proximal portion of the rear shield extends proximally of the front shield shell 920; cooling the front shield shell while the rear shield shell is positioned within so that a distal ridge or flange of the rear shield shell engages an inner surface of the front shield shell during cooling 930; fixedly attaching the rear shield shell to the front shield shell at a point of contact between the shield shells 940; inserting a terminal insert into the front shield shell and electrically coupling a cable to the terminal insert near the rear shield shell 950;

and advancing a boot member over the cable so as to fittingly receive the proximal portion of the rear shield shell extending proximally so that an outer surface of the boot member is about flush with an outer surface of the front shield shell with minimal gap or space therebetween 960.

Although the invention has been described with respect to specific embodiments, it will be appreciated that the invention is intended to cover all modifications and equivalents within the scope of the following claims. For example, although the embodiments herein are often directed at connector plugs that are rectangular in shape, such as a USB connector plug, the invention may encompass various other connector devices, or connector plugs of various sizes and/or shapes, such as circular or trapezoidal connector plugs and devices.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector, comprising:

a front shield shell having an axial passageway therethrough, the front shield shell comprising a material having a coefficient of thermal expansion such that the front shield shell has an expanded profile at a first temperature and a reduced profile at a second temperature, the second temperature being lower than the first;

a rear shield shell having a distal portion and a proximal portion, and an axial passageway extending therethrough, wherein the distal portion extends at least partially into the axial passageway of the front shield shell, wherein the front shield shell is dimensioned such that, when the rear shield shell is at the second temperature and the front shield shell is at the first temperature, the distal portion of the rear shield shell is receivable within the axial passageway of the front shield shell;

a boot member having an axial passageway therethrough extending from a proximal opening to a distal opening and a distal cavity at the distal opening, the distal cavity being dimensioned so as to fittingly receive the proximal portion of the rear shield shell such that an outer surface of the boot member is about flush with an outside surface of the front shield shell along a length of the connector; and a plurality of terminals disposed within the front shield shell, the plurality of terminals electrically coupled to a cable through the rear shield shell and the boot member.

2. The connector of claim 1, wherein the distal portion of the rear shield shell has a greater cross-sectional area than that of the proximal portion.

3. The connector of claim 1, wherein the distal portion of the rear shield shell comprises a raised edge extending outward toward the inside surface of the front shield shell so as to contact the inside surface when the front shield shell cools to the second temperature while the rear shield shell is disposed within.

4. The connector of claim 3, wherein the raised edge is substantially continuous about a distal opening of the rear shield shell.

5. The connector of claim 1, wherein the distal portion of the rear shield shell comprises a plurality of tabs extending radially outward so as to contact an inside surface of the front shield shell when cooled at the second temperature, after being received within the axial passageway of the front shield shell at the first temperature.

6. The connector of claim 3, wherein one or both of the front and rear shield shell comprise a metal.

7. The connector of claim 6, wherein one or both of the front and rear shield shell comprise stainless steel.

8. The connector of claim 6, wherein the front and rear shield shell each comprise a metal of about the same composition.

9. The connector of claim 6, wherein the front and rear shield shell comprise metals of different compositions.

10. The connector of claim 1, wherein the first temperature is at least about 200 degrees Celsius.

11. The connector of claim 10, wherein the second temperature is about room temperature.

12. The connector of claim 3, wherein the raised edge of the distal portion of the rear shield shell is fixedly attached to the inside surface of the front shield shell within the axial passageway of the front shield shell.

13. The connector of claim 12, wherein the rear shield shell and front shield shell are fixedly attached with an adhesive.

14. The connector of claim 13, wherein the rear shield shell and front shield shell are fixedly attached with a weld.

15. The connector of claim 14, wherein the weld is a substantially continuous weld circumscribing the axial passageway.

16. The connector of claim 1, wherein the boot member comprises a distal edge dimensioned so as to abut against a proximal edge of the front shield shell when the proximal portion of the rear shield shell is fittingly received within the distal cavity.

17. A method of manufacturing a connector, the method comprising:

providing an open-ended front shield shell and a rear shield shell, the front shield shell having an expanded profile at a first temperature and a reduced profile at a second profile due to a coefficient of thermal expansion of a material comprising the front shield shell, the second temperature being lower than the first;

heating the front shield shell to the first temperature;

placing the rear shield shell within the front shield shell, while the front shield shell is at the first temperature and the rear shield shell is at the second temperature;

positioning the rear shield shell relative to the front shield shell so that a distal portion of the rear shield shell is within the front shield shell and a proximal portion extends outside of the front shield shell;

cooling the front shield shell to the second temperature so as to produce line-to-line contact between an inside surface of the front shield shell in the reduced profile and an outer surface of the rear shield shell;

fixedly attaching the front shield shell and rear shield shell at the line-to-line contact between the front shield shell and the rear shield shell; and advancing a boot member over the proximal portion of the rear shield shell so that an outer surface of the boot is about flush with an outer surface of the front shield shell along a length of the connector.

18. The method of claim 17 wherein advancing the boot member over the proximal portion of the rear shield shell comprises advancing the boot member until a distal edge of the boot member abuts against a proximal edge of the front shield shell so as to substantially minimize and/or eliminate a gap between the distal edge and proximal edge.

19. The method of claim 17 wherein a differential between the first and second temperature is within a range of about 150-200 degrees Celsius.

20. The method of claim 19 wherein the temperature differential between the first and second temperature is about 175 degrees Celsius.

21. The method of claim 17 wherein the first temperature is at least 200 degree Celsius.

22. The method of claim 21 wherein the second temperature is about room temperature.

23. The method of claim 17 wherein fixedly attaching the front shield shell and rear shield shell comprises applying an adhesive to the line-to-line contact.

24. The method of claim 17 wherein fixedly attaching the front shield shell and rear shield shell comprises welding the rear shield shell to the front shield shell at the line-to-line contact.

* * * * *